US007003245B2

(12) United States Patent
Leemhuis et al.

(10) Patent No.: US 7,003,245 B2
(45) Date of Patent: Feb. 21, 2006

(54) DOOR ASSEMBLY FOR AN IMAGE FORMING DEVICE

(75) Inventors: Michael Craig Leemhuis, Nicholasville, KY (US); Donn Duane Bryant, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 67 days.

(21) Appl. No.: 10/804,551

(22) Filed: Mar. 19, 2004

(65) Prior Publication Data

US 2005/0207785 A1 Sep. 22, 2005

(51) Int. Cl.
*G03G 15/00* (2006.01)
*G03G 15/02* (2006.01)

(52) U.S. Cl. ..... 399/116; 399/111; 399/119

(58) Field of Classification Search ..... 399/107, 399/111, 113, 114, 116, 117, 119, 167
See application file for complete search history.

(56) References Cited

U.S. PATENT DOCUMENTS

| | | | | |
|---|---|---|---|---|
| 4,876,572 A | | 10/1989 | Nagatsuna | |
| 5,136,333 A | * | 8/1992 | Craft et al. | 399/111 |
| 5,907,751 A | | 5/1999 | Kawaguchi et al. | |
| 6,249,661 B1 | | 6/2001 | Saitoh et al. | |
| 6,640,069 B1 | | 3/2002 | Kanemoto | |

* cited by examiner

*Primary Examiner*—Hoang Ngo
(74) *Attorney, Agent, or Firm*—Coats and Bennett, PLLC

(57) ABSTRACT

A device and method of connecting a cartridge unit to a door assembly of an image forming device. The door assembly includes a first mount having a first configuration, and a second mount having a second different configuration. The cartridge unit includes a first attachment for connecting to the first mount, and a second attachment for connecting to the second mount. The cartridge unit is connected and does not become disengaged when the door assembly moves between open and closed orientations. Method of using the attachments are also disclosed that include mounting one of the attachments to the corresponding mount, and then moving the cartridge unit to mount the other attachment to the other mount.

27 Claims, 8 Drawing Sheets

DOOR ASSEMBLY FOR AN IMAGE FORMING DEVICE

BACKGROUND

Image forming devices, such as printers, often include replaceable components, such as toner cartridges, PC members, etc. These components are used during the image formation process and are eventually worn-out or exhausted. Users should be able to remove and replace these components when necessary.

Placement and mounting of these components is vital to acceptable user ergonomics. The components should be positioned in a manner to be accessible to the user. The complex design of many current devices makes accessing the components difficult. The cartridges may be located within the interior of the device making it very difficult to grasp and manipulate the cartridges. Difficult cartridge mounting locations may also result in the user getting toner on their hands and fingers by inadvertently contacting the toner outlet on the cartridge. Additionally, some of the components may be damaged during mounting, such if contacted by the user's hands or fingers, or scrapped against the device. Damaged components may result in print defects, or the device not operating properly.

It is also important that the components be mounted within the device to produce images of acceptable print quality. This requires that the components are accurately located within the device during image formation. Inaccurate locating of the cartridges may result in image forming defects, toner leakage, and other detrimental effects.

Further, the device should be constructed in an economical manner. Price is one of the leading factors when a user makes a purchasing decision for an image forming device. Improvements to user ergonomics and component locations should add to functionability of the device, but not at a price that will drive away potential users.

SUMMARY

The present invention is directed to mounting a unit on a door assembly of an image forming device. In one embodiment, a first mount and a second mount are positioned on the door assembly. A cartridge unit includes a first attachment and a second attachment that connect respectively to the first and second mounts. Once connected, the cartridge unit remains attached as the door assembly moves between open and closed orientations.

The attachment of the cartridge unit is straight-forward and intuitive to the user. The design also prevents the cartridge unit from being installed backwards. Further, the attachments and mounts are positioned to not interfere with the image forming process.

DETAILED DESCRIPTION

Figure 1:
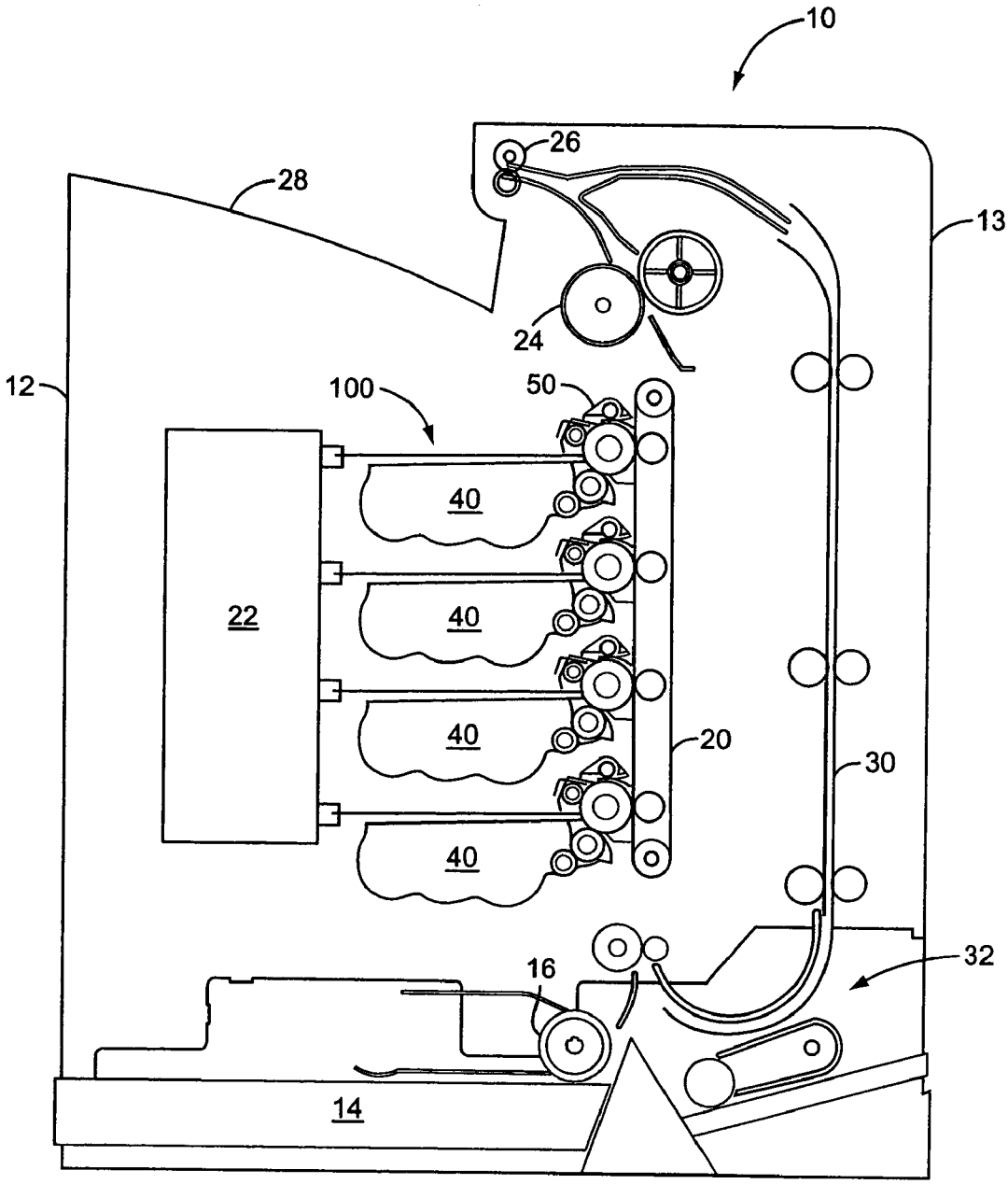
FIG. 1 is a schematic view of an image forming device in a closed orientation according to one embodiment of the present invention.

FIG. 1 depicts a representative image forming device, such as a printer, indicated generally by the numeral 10. The image forming device 10 comprises a main body 12 and a door assembly 13. A media tray 14 with a pick mechanism 16, or a manual input 32, are conduits for introducing media sheets into the device 10. The media tray 14 is preferably removable for refilling, and located on a lower section of the device 10.

Media sheets are moved from the input and fed into a primary media path. One or more registration rollers disposed along the media path align the print media and precisely control its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100 as part of the image formation process. The media sheet with loose toner is then moved through a fuser 24 that adheres the toner to the media sheet. Exit rollers 26 rotate in a forward or a reverse direction to move the media sheet to an output tray 28 or a duplex path 30 respectively. The duplex path 30 directs the inverted media sheet back through the image formation process for forming an image on a second side of the media sheet.

The image forming units 100 are constructed of a first unit 40 and a second unit 50. The first unit 40, including a developer member 45, is positioned within the main body 12. The second unit 50, including a photoconductive member 51, is mounted to the door assembly 13. In a closed orientation as illustrated in FIG. 1, the door assembly 13 is positioned adjacent to the main body 12 with the photoconductive member 51 of the second unit 50 against the developer member 45 of the first unit 40.

Figure 2:
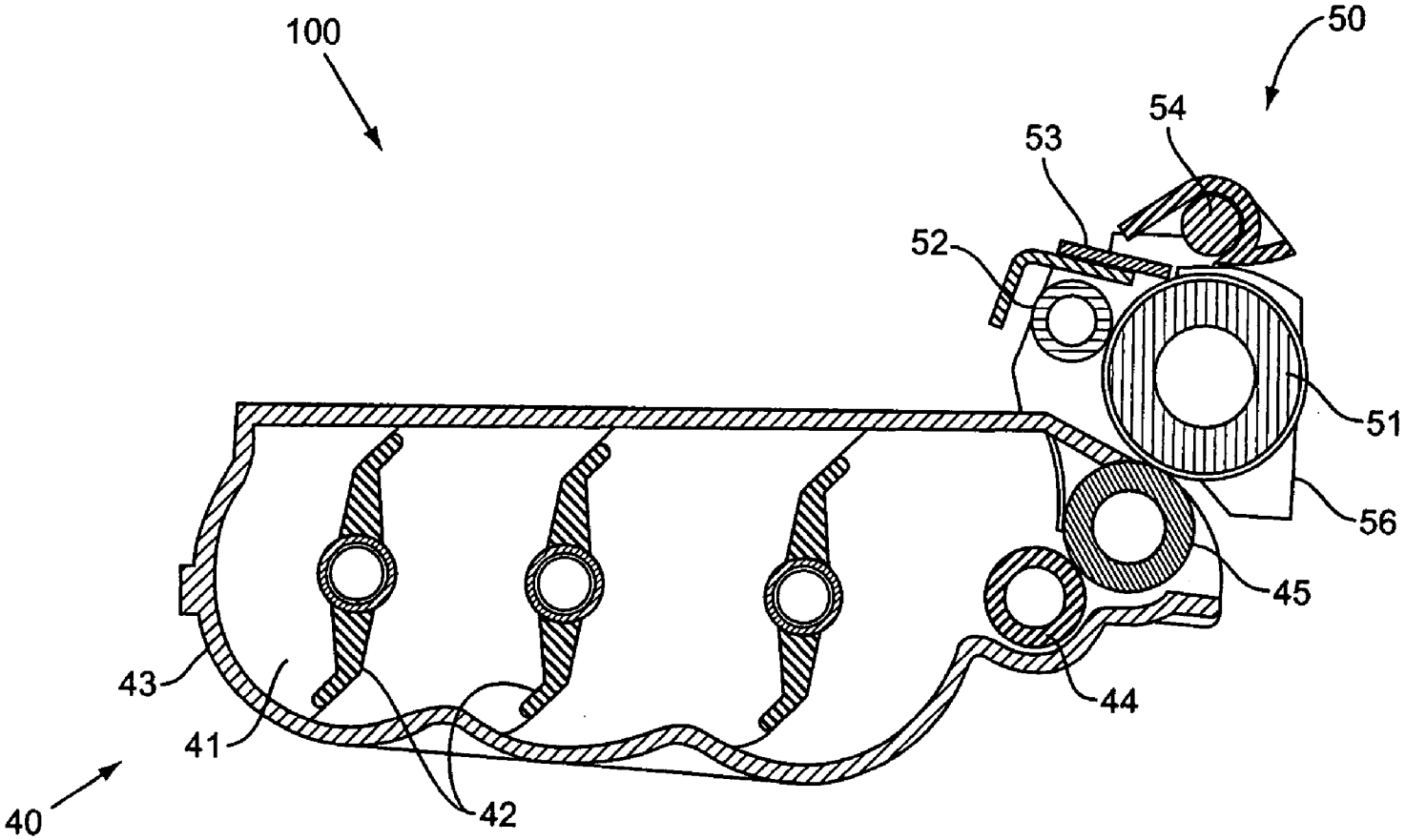
FIG. 2 is a cut-away perspective view of the door in an open orientation according to one embodiment of the present invention.

FIG. 2 illustrates a cross-sectional view of the image forming unit 100 in the closed orientation. The first unit 40 comprises an exterior housing 43 that forms a reservoir 41 for holding a supply of toner. One or more agitating members 42 are positioned within the reservoir 41 for agitating and moving the toner towards a toner adder member 44 and the developer member 45. Toner moves from the reservoir 41 via the one or more agitating members 42, to the toner adder roll 44, and finally is distributed to the developer member 45. The first unit 40 may be structured with the developer member 45 on an exterior section where it is accessible for being in contact with the photoconductive member 51.

The second unit 50 is illustrated in FIG. 2 and comprises the photoconductive member 51, and a charger 52. In one embodiment, photoconductive member 51 is an aluminum hollow-core drum coated with one or more layers of light-sensitive organic photoconductive materials. Charger 52 applies an electrical charge to the photoconductive member 51 prior to the member receiving an electrostatic latent image from the imaging device 22. A cleaner blade 53 contacts the surface of the photoconductive member 51 to remove any toner that remains on the photoconductive member 51. The residual toner is moved to a waste toner auger 54 and moved out of the second unit 50. A housing 56 forms the exterior of a portion of the second unit 50. The photoconductive member 51 may be mounted on an exterior of the second unit 50 so it may be placed in contact with the developer member 45.

Figure 3:
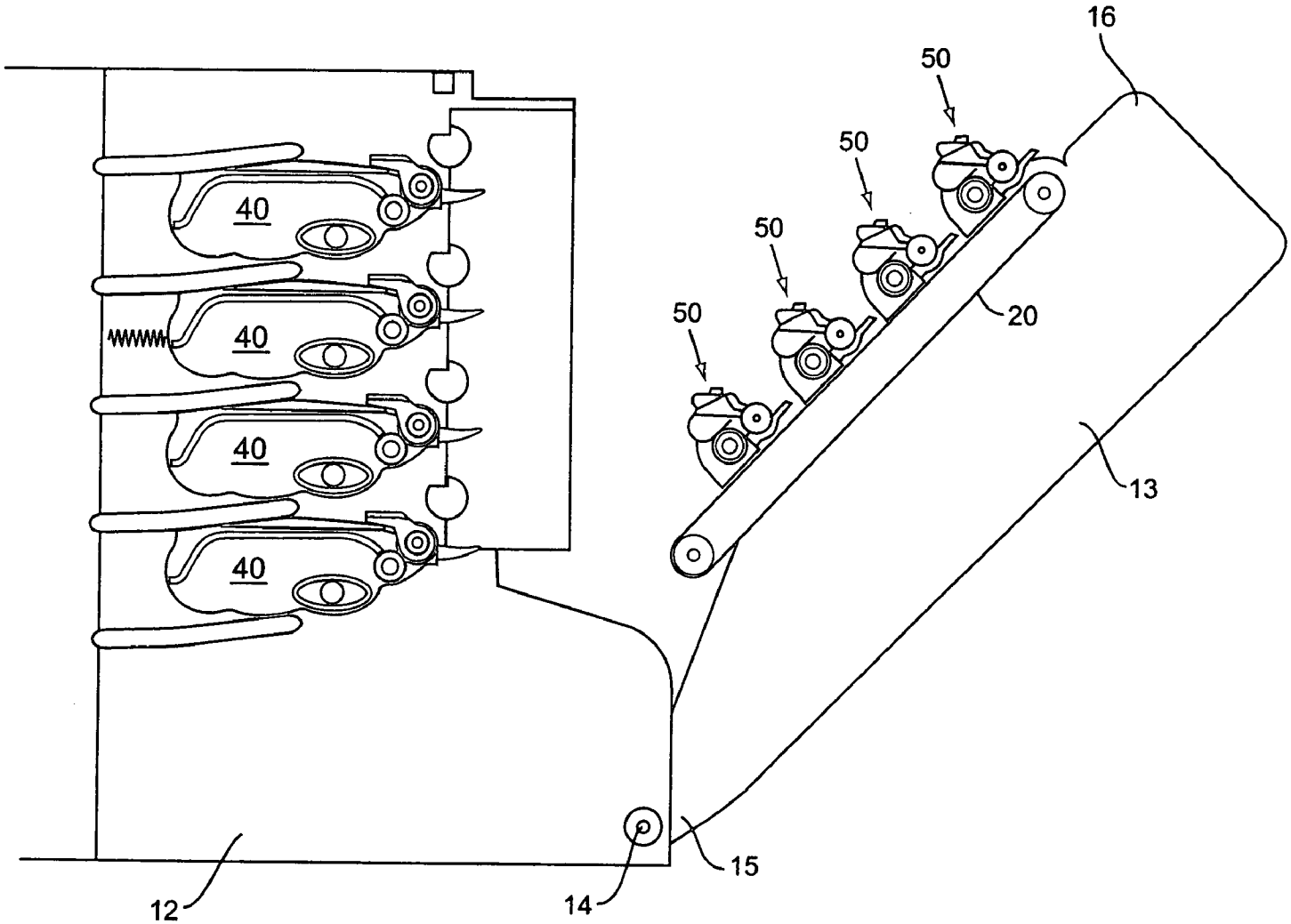
FIG. 3 is a cut-away side view of the door assembly in an open orientation according to one embodiment of the present invention.
Figure 8:
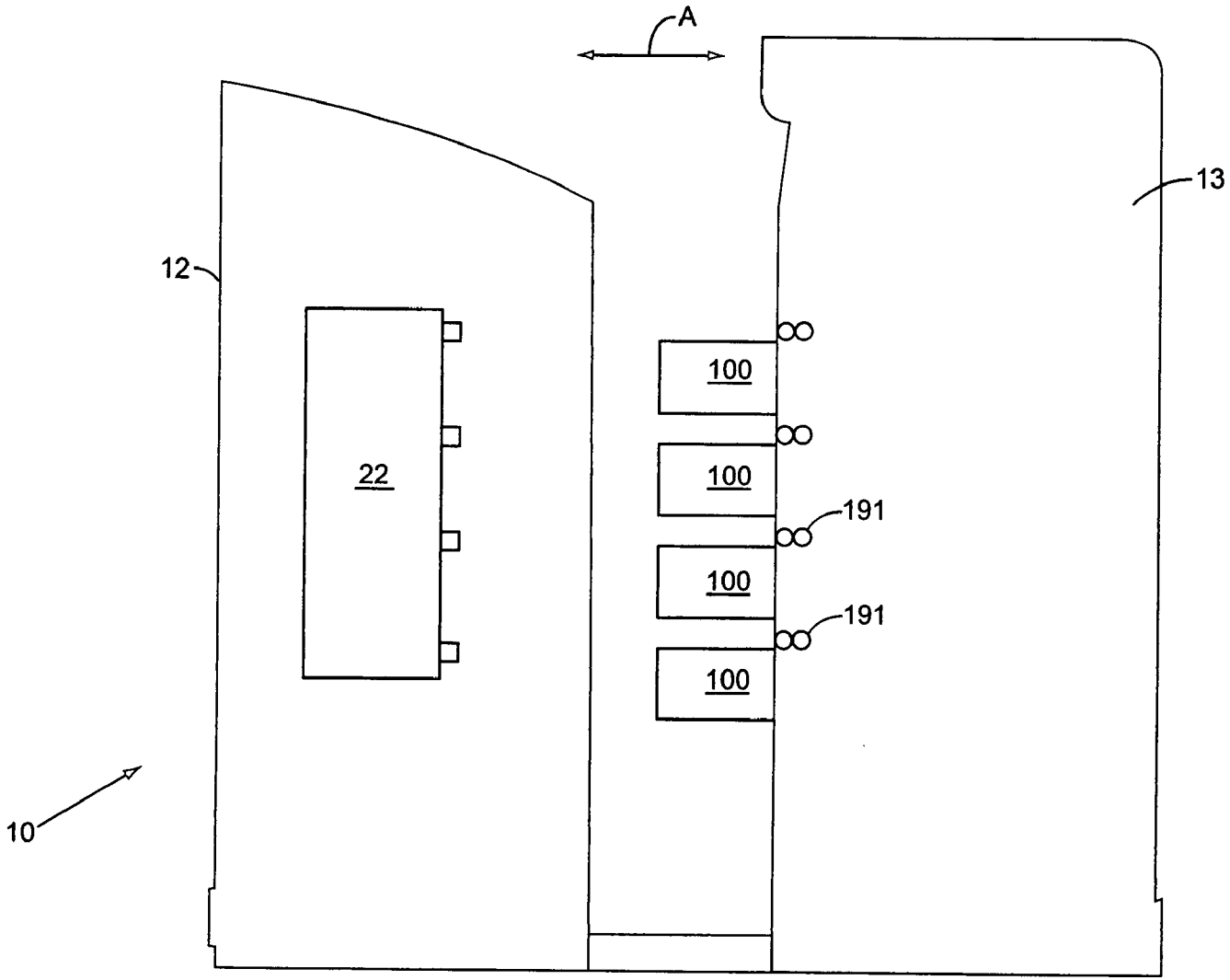
FIG. 8 is a schematic view of another embodiment of an image forming device in an open orientation.

FIG. 3 illustrates the image forming device 10 in the open orientation with the door assembly 13 moved away from the main body 12. The second units 50 are mounted on the door assembly 13 and distanced from the first units 40 within the main body 12. In this embodiment, door assembly 13 pivots about a pivotable connection 14 positioned towards a lower edge 15 of the door assembly 13. The position of the connection 14 causes an upper edge 16 to move away from the main body 12. In another embodiment, door assembly 13 remains in a vertical orientation as illustrated in FIG. 8 as it moves between the open and closed configurations. The open configuration provides direct and easy user access to the first unit 40, second unit 50, and the media path. It has been determined that the highest user intervention rates are at the first unit 40, second unit 50, and media path.

The door assembly 13 includes attachments for connecting the second units 50. The attachments should make installation and removal easy and intuitive to the user, should not interfere with the image forming process, should maintain attachment of the second units 50 as the door assembly 13 moves between the open and closed orientations, and should not allow the second units 50 to be installed backwards. The door assembly 13 comprises a first mount 110 and a second mount 120 to receive the second units 50.

Figure 4:
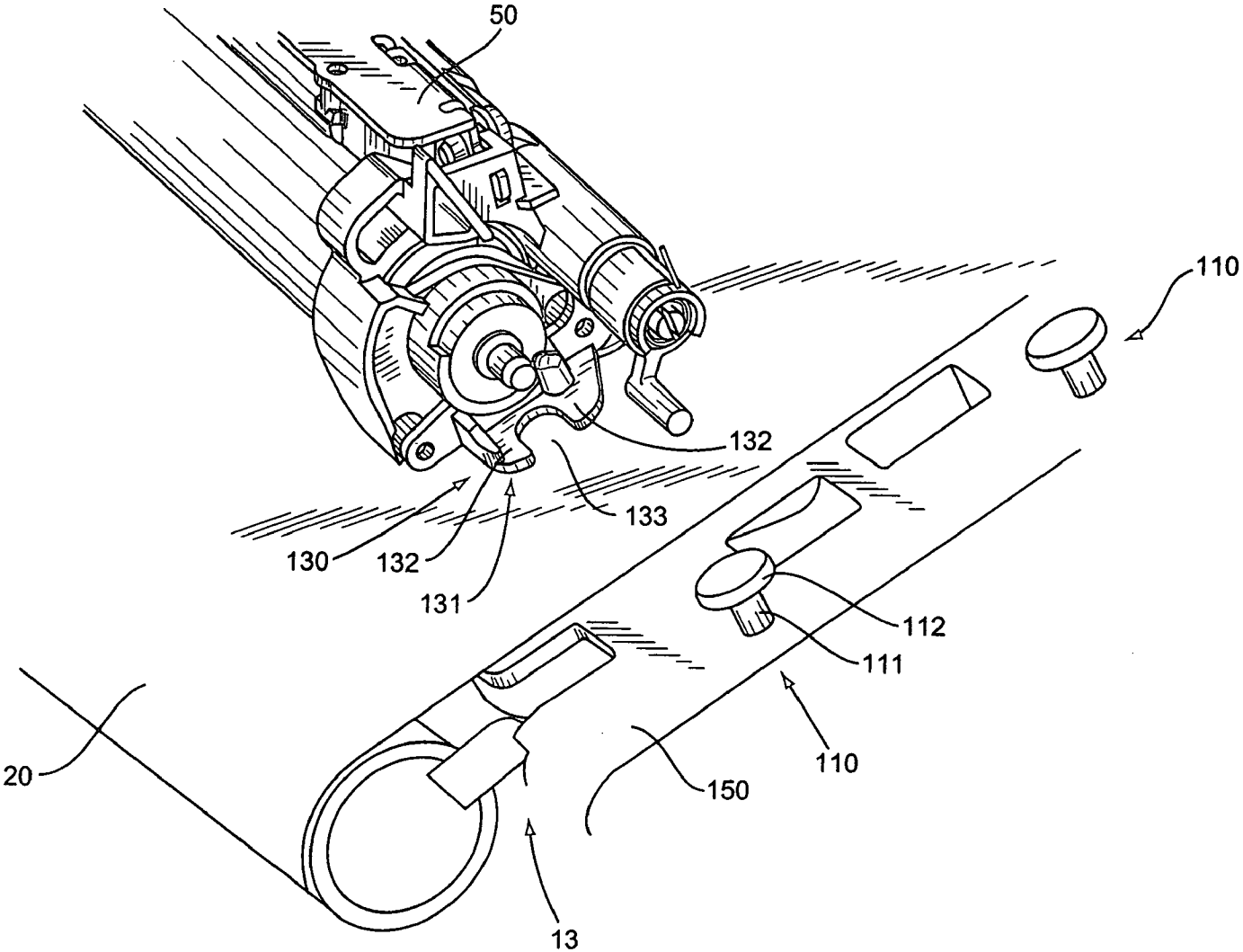
FIG. 4 is a partial perspective view of the first attachment distanced from the first mount according to one embodiment of the present invention.
Figure 5:
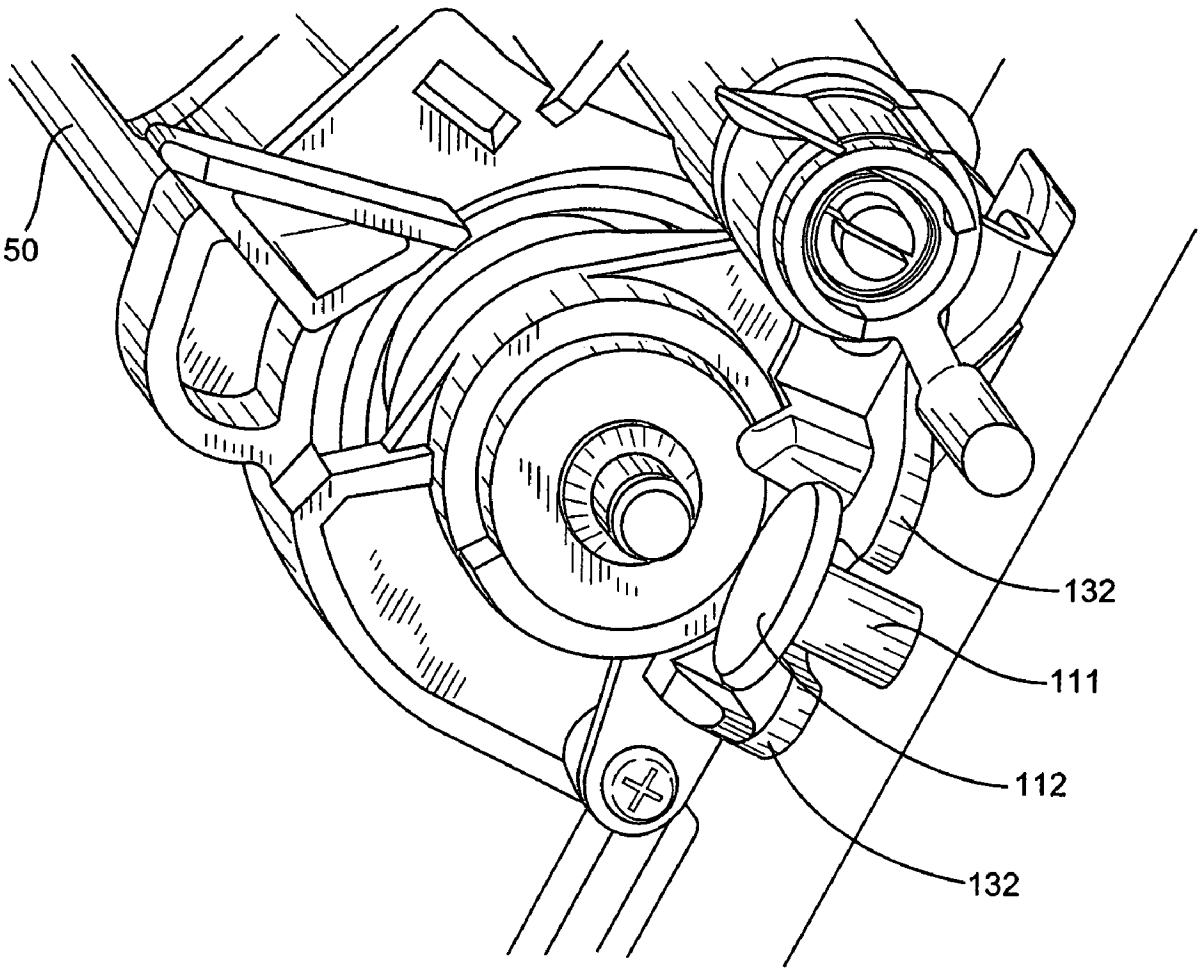
FIG. 5 is a partial perspective view of the first attachment connected to the first mount according to one embodiment of the present invention.

FIGS. 4 and 5 illustrate one embodiment of the first mount 110 having a T-shaped configuration with a post 111 and a cap 112. The post 111 extends outward at an angle substantially perpendicular to the door assembly 13. The cap 112 is positioned at a distal end of the post 111. The cap 112 has a width greater than a width of the post forming the T-shaped configuration. The larger width maintains the cartridge attached to the first mount 110 as will be explained in detail below.

Figure 6:
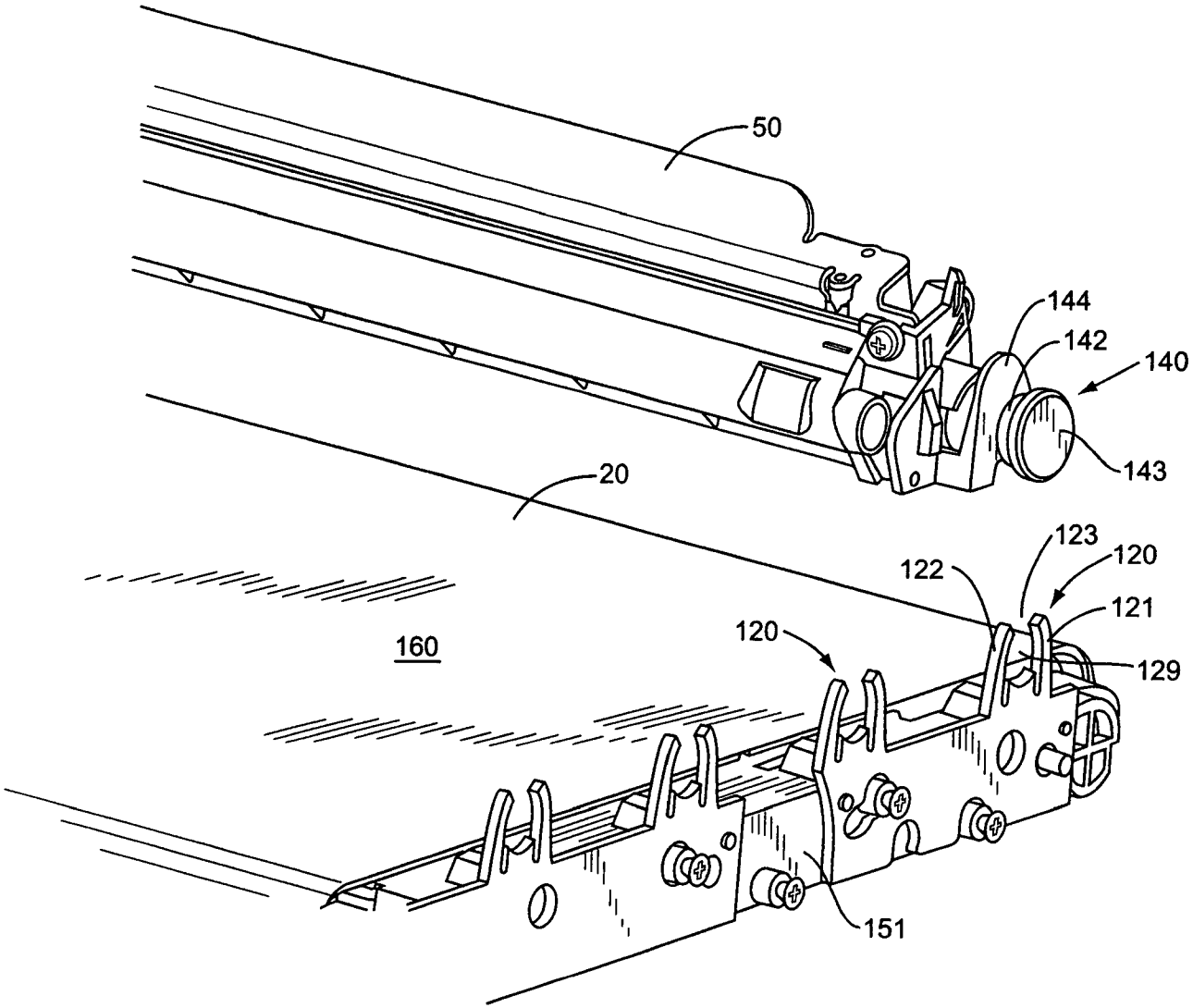
FIG. 6 is a partial perspective view of the second attachment distanced from the second mount according to one embodiment of the present invention.
Figure 7:
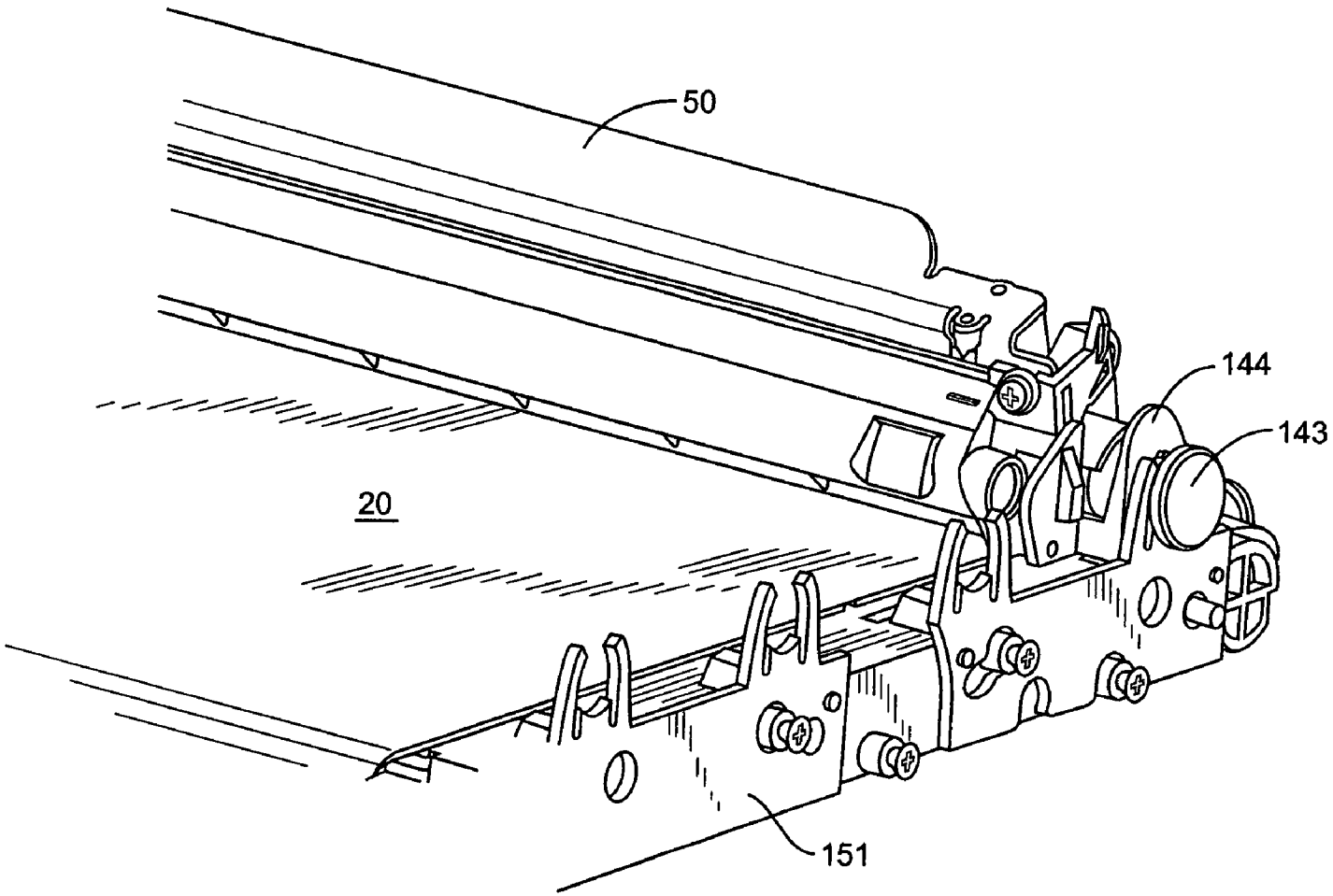
FIG. 7 is a partial perspective view of the second attachment connected to the second mount according to one embodiment of the present invention.

FIGS. 6 and 7 illustrate one embodiment of the second mount 120 having a first finger 121 and a second finger 122. One or both of the fingers 121, 122 have a curved configuration with a channel 123 formed between the distal ends. In one embodiment, the curved configuration forms the channel 123 at a distal end, and an enlarged opening 129 between the distal ends and the door assembly 13. The channel 123 has a width that is smaller than a width of the opening. In one embodiment, the fingers 121, 122 have the same shape.

In a multi-color image forming device, a plurality of first mounts 110 and second mounts 120 are positioned on the door assembly 13 to receive the plurality of image forming units 100. The first mounts 110 are positioned adjacent to a first side 150 of the door assembly 13, and the second mounts 120 are positioned adjacent to a second side 151 that is opposite the first side. The mounts 110, 120 are positioned outside of a working area 160 to not interfere with the image formation process. In one embodiment, the working area comprises the transport belt 20 and the mounts 110, 120 are positioned adjacent to each side.

The second unit 50 includes a first attachment 130 and a second attachment 140. In one embodiment, first attachment 130 is positioned at a first end of the second unit 50 and the second attachment is positioned at a second opposite end of the second unit 50.

First attachment 130 is sized to connect with the first mount 110. In one embodiment, the first attachment 130 includes a U-shaped slot 131 formed by members 132 that are spaced a distance apart forming an opening 133 therebetween. The slot 131 has a width that is greater than the width of the post 111 of the first mount 110, but smaller than the width of the cap 112.

The second attachment 140 is sized to connect with the second mount 120. In one embodiment, the second attachment 140 includes a neck 142 and a head 143. The neck 142 has a narrow width that is smaller than the width of the channel 123 of the second mount 120. The head 143 is positioned on an exterior side of the neck 142 and has a width greater than the channel width. The width of the head 143 may also be greater than a width of the opening 129 formed between the fingers 121, 122 of the second mount 120. The second attachment 140 is connected to the second mount 120 with the neck 142 within the channel 123. The head 143 prevents the neck 142 from laterally sliding out of the second attachment 140. A positioner 144 may also be located on the inside of the neck 132. The positioner has a width greater than the width of the channel 123 and opening 129 to prevent the second unit 50 from sliding laterally.

In one embodiment, a centerline of the U-slot 131 is aligned with an axis of the photoconductive member 51. A centerline of the neck 142 and head 143 is also aligned with the axis of the photoconductive member 51. In one embodiment, the centerline of the neck 142 and head 143 and the photoconductive member 51 are the same.

During the installation process, the user is unable to mount the cartridge in the wrong orientation (i.e., upside-down) because the first attachment 130 connects with the first mount 110, and the second attachment 140 connects with the second mount 120. Attempts to improperly connect the cartridge are not successful. The user begins the process by initially mounting the slot 131 about the post 111. The slot 131 is prevented from lifting off the post 111 because the width of the cap 112 is larger than the width of the slot 131. Once the first attachment 130 is mounted, the unit is pivoted about the first attachment 130 such that the second attachment 140 connects to the second mount 120. Specifically, the neck 142 pushes through the channel 123 and is held between the fingers 121, 122. One or both fingers 121, 122 may be constructed of a flexible material such that the channel 123 expands during the insertion and than returns to the original size once the neck 142 has moved into the opening 129 formed below the distal ends of the fingers 121, 122.

Once the unit is mounted within the mounts 110, 120, the PC member 51 is positioned over the work area 160. In one embodiment, the PC member 51 is positioned adjacent to the transport belt 20 such that media sheets moving along belt 20 receive toner images from the PC member 51.

The unit 50 is roughly mounted to the door assembly 13 with enough play to provide for exact locating via the contact with the main body 12. Movement between the unit 50 and door assembly 13 may be caused by the width of the slot 131 being larger than the width of the post 111. In one embodiment, there is about 1 mm clearance when the first attachment 130 is connected to the first mount 110. Likewise, the width between the fingers 121, 122 is greater than a width of the neck 142. In one embodiment, there is about 1 mm of clearance. The cartridge is slightly movable on the door assembly 13, and becomes accurately located and fixed once the door is closed. The looseness of the connections is still adequate to maintain the unit 50 attached to the door assembly 13, even when moving the door assembly 13 between the open and closed orientations.

In one embodiment, the unit 50 is specifically located relative to the main body 12 when the door assembly 13 is in the closed orientation. One or more reference datums positioned on the main body 12 accurately locate the unit 50, and the photoconductive member 51 relative to the developer member 45. One embodiment of a two-piece unit and locating the units relative to the main body and imaging device is disclosed in U.S. patent application Ser. No. 10/804,488 entitled "Image Forming Device Having a Door Assembly and Method of Use", concurrently filed with the present application, assigned to Lexmark International, Inc., and herein incorporated by reference in its entirety.

FIG. 8 is a schematic illustration of another embodiment of an image forming device 10. One or more image forming units 100 are mounted on the door assembly 13. Each of the image forming units 100 includes both the developing and image forming elements and is constructed as a single unit. The door assembly 13 is movable relative to the main body 12 and imaging device 22 between an open orientation as illustrated in FIG. 8 and a closed orientation mounted against the main body 12. In the open orientation, the image forming units 100 are accessible to the user, and mounted to the door assembly 13 in a similar manner as described above.

The term "image forming device" and the like is used generally herein as a device that produces images on a media sheet. Examples include but are not limited to a laser printer, ink-jet printer, fax machine, copier, and a multi-functional printer, scanner, and facsimile machine. One example of an image forming device is Model No. C750 produced by Lexmark International Inc.

The term "imaging device" refers to a device that places an electrical charge on the photoconductive element 51. Various imaging devices may be used such as a laser printhead and a LED printhead.

A transport belt 20 is illustrated in the embodiments for moving the media sheets past the image forming units 100, and as part of the door assembly 13. In another embodiment, roller pairs 191 are mounted to the door assembly 13 and spaced along the media path. The roller pairs 191 rotate to move the media sheets past the image forming units 100. In one embodiment, each of the roller pairs is mounted on the door assembly 13. In another embodiment, one of the rollers is mounted on the door, and the corresponding roller of the pair is mounted on the main body 12.

The present invention may be carried out in other specific ways than those herein set forth without departing from the scope and essential characteristics of the invention. In one embodiment, both the photoconductive member 51 and the developer member 45 are cylindrically shaped. The present embodiments are, therefore, to be considered in all respects as illustrative and not restrictive, and all changes coming within the meaning and equivalency range of the appended claims are intended to be embraced therein.

What is claimed is:

1. A door assembly for an image forming apparatus comprising:

a door;

a first mount and a second mount being spaced apart and attached to the door, the first mount having a post and a cap with the post extending outward from the door and the cap spaced from the door and extending outward beyond the post; the second mount having opposing fingers extending outward from the door and forming a channel; and a cartridge having a photoconductive member and being connected to the door by the pair of mounts, the cartridge comprising a first attachment mechanism having a slot with a slot width greater than a width of the post and less than a cap width, and a second attachment mechanism having a neck that seats within the second mount as a neck width is less than a width of the channel.

2. The assembly of claim 1, wherein the door includes a pivot adjacent to a lower edge to be positionable relative to the image forming apparatus between an open orientation with an upper edge spaced from the image forming apparatus, and a closed orientation with the upper edge adjacent to the image forming apparatus.

3. The assembly of claim 1, wherein the photoconductive member has a toner transfer section and the first attachment mechanism is positioned beyond a first edge of the toner transfer section and the second attachment mechanism is positioned beyond a second edge of the toner transfer section with the first attachment mechanism spaced on an opposite side of the cartridge from the second attachment mechanism.

4. The assembly of claim 1, wherein the cartridge further comprises a charger for electrically charging the photoconductive member.

5. The assembly of claim 1, wherein the slot is aligned with a centerline of the photoconductive member.

6. The assembly of claim 1, further comprising a head positioned on an outer side of the neck away from the photoconductive member, the head having a width greater than the channel width.

7. The assembly of claim 1, wherein the first mount is substantially T-shaped.

8. The assembly of claim 1, wherein the cap is positioned at a distal end of the post.

9. The assembly of claim 1, wherein the opposing fingers each have a curved orientation that forms an opening between the channel and door with a width of the opening being greater than the channel width.

10. The assembly of claim 9, wherein the channel is formed by distal ends of the opposing fingers.

11. A door assembly for an image forming apparatus comprising:

a door;

a cartridge with a photoconductive member and having a first attachment and a second attachment to attach the cartridge to the door;

a first mount positioned on the door and having a first configuration to receive the first attachment; and a second mount positioned on the door and having a second configuration to receive the second attachment, the first configuration and the second configuration being different such that only the first attachment can attach to the first mount and only the second attachment can attach to the second mount.

12. The assembly of claim 11, wherein the cartridge has a first side and a second side, the first side is mounted above the second side relative to the door when the first attachment is mounted to the first mount and the second attachment is mounted to the second mount.

13. The assembly of claim 11, wherein the first mount and the second mount each extend outward from the door, and the first attachment is aligned along a first dimensional plane and the second attachment is aligned along a second dimensional plane that is substantially perpendicular to the first dimensional plane.

14. A door assembly for an image forming apparatus comprising:

a door;

a plurality of first mounts spaced along a first edge of the door, each of the plurality of first mounts having a post and a cap with the post extending outward from the door and the cap spaced from the door and extending outward beyond a width of the post;

a plurality the second mounts spaced along a second edge of the door opposite from the first edge, each of the plurality of second mounts having opposing fingers extending outward from the door and forming a channel; and a plurality of cartridges each removably attached to the door, each of the plurality of cartridges having a photoconductive member, a first attachment mechanism having a slot with a slot width greater than a post width and less than a cap width, and a second attachment mechanism having a neck that seats within the second mount as a neck width is less than a width of the channel.

15. The device of claim 14, wherein the plurality of cartridges comprises a first cartridge having black toner, a second cartridge having cyan toner, a third cartridge having magenta toner, and a fourth cartridge having yellow toner.

16. A cartridge for an image forming device having a first end with a first attachment with a pair of spaced-apart fingers forming a slot, and a second end with a second attachment with a neck and a head, the head positioned on an outer side of the neck away from the first end, and the neck having a smaller width than the head.

17. The device of claim 16, further comprising a photoconductive member positioned between the first attachment and the second attachment.

18. The device of claim 17, further comprising a charger positioned between the first attachment and the second attachment to electrically charge the photoconductive member.

19. A cartridge for an image forming device comprising:

a photoconductive member having a first end and a second end;

a first attachment mechanism positioned adjacent to the first end and having a slot extending inward a predetermined distance from an outer edge, and a second attachment mechanism positioned adjacent to the second end and having a neck and a head, the head positioned on an outer side of the neck away and having a smaller width than the head.

20. The cartridge of claim 19, wherein the photoconductive member is a drum having a hollow interior.

21. The cartridge of claim 19, wherein the neck and the head are co-axially aligned with the photoconductive member.

22. A method of mounting a cartridge assembly to a door of an image forming apparatus, the method comprising the steps of:

moving the cartridge in a horizontal direction and attaching a first end of the cartridge to the door;

while the first end remains attached, moving the cartridge in a vertical direction and attaching a second end of the cartridge to the door; and moving the door from an open orientation to a closed orientation and maintaining the attachment of the cartridge to the door.

23. The method of claim 22, wherein the step of moving the door from the open orientation to the closed orientation comprises pivoting the door along a pivot on a lower edge of the door.

24. The method of claim 22, further comprising preventing the first end of the cartridge from moving while the second end of the cartridge is attached.

25. A method of mounting a cartridge assembly to a door of an image forming apparatus, the method comprising the steps of:

attaching a slot on a first end of the cartridge to a T-shaped member on a first door side;

attaching a neck on a second end of the cartridge in a channel formed between two fingers on a second door side; and positioning the photoconductive member within a working area of the door between the first door side and the second door side.

26. The method of claim 25, wherein the step of positioning the photoconductive member within a working area comprises aligning the photoconductive member with a transfer belt on the door.

27. The method of claim 25, further comprising moving the first end of the cartridge substantially parallel to the door to attach the slot to the T-shaped member, and moving the second end of the cartridge substantially perpendicular to door to attach the neck to the channel.

* * * * *